United States Patent [19]

Lenders

[11] Patent Number: 4,805,440

[45] Date of Patent: Feb. 21, 1989

[54] PUNCHING OR STAMPING MACHINE

[75] Inventor: Henricus J.P. Lenders, Tilburg, Netherlands

[73] Assignee: U.S. Philips Corporation, New York, N.Y.

[21] Appl. No.: 62,759

[22] Filed: Jun. 16, 1987

[30] Foreign Application Priority Data

Aug. 22, 1986 [GB] United Kingdom ..... 8620470

[51] Int. Cl.[4] ..... B21D 37/12

[52] U.S. Cl. ..... 72/455; 72/456; 72/433; 72/342; 83/170; 100/214; 100/38

[58] Field of Search ..... 72/342, 455, 456, 445, 72/438, 433; 100/214, 35, 38; 83/170

[56] References Cited

U.S. PATENT DOCUMENTS

| | | | |
|---|---|---|---|
| 1,300,324 | 4/1919 | Amos | 72/445 |
| 1,400,416 | 12/1921 | Cameron | 72/445 |
| 1,952,908 | 3/1934 | Connell | 72/433 |
| 3,668,917 | 6/1972 | Komatsu et al. | 72/342 |
| 3,703,093 | 11/1972 | Komatsu et al. | 72/342 |

*Primary Examiner*—David Jones

[57] ABSTRACT

A punching or stamping machine for operating on thin material with very high precision comprises a horizontally disposed, elongate fixed base (1) and a hollow movable arm (2) extending parallel to the base and connected to it at one end by a resiliently flexible web (3). At the other end, on machined faces (8 and 9), the arm and the base each carry a set of tools, for example, a set of punches and a corresponding set of dies. The web (3) forms a connection between the arm and the base which will permit the necessary operative movement of the arm in the vertical direction but will not allow significant displacement of the arm relative to the base in a horizontal direction, thus contributing to a maintenance in the accuracy of alignment of the punches and dies which is better than that available with a pivotal connection, which is subject to frictional wear. A further contribution is made by interconnecting the base and the arm with flexible elements of a material of good thermal conductivity, for example, braided copper strips (25), in order to permit a ready transfer of heat between the base and the arm so that a thermal balance is maintained between them which inhibits differential thermal expansion or contraction of the base and the arm. Such differential expansion or contraction can result in a movement of the arm relative to the base which can affect the alignment of the punches and the dies. In order to obtain a quicker heat transfer between the arm and the base the arm is preferably lined with copper strips (33) which have heat-conducting connection with the flexible connecting strips (25) via copper rivets (31).

6 Claims, 3 Drawing Sheets

PUNCHING OR STAMPING MACHINE

DESCRIPTION

Figure 1:
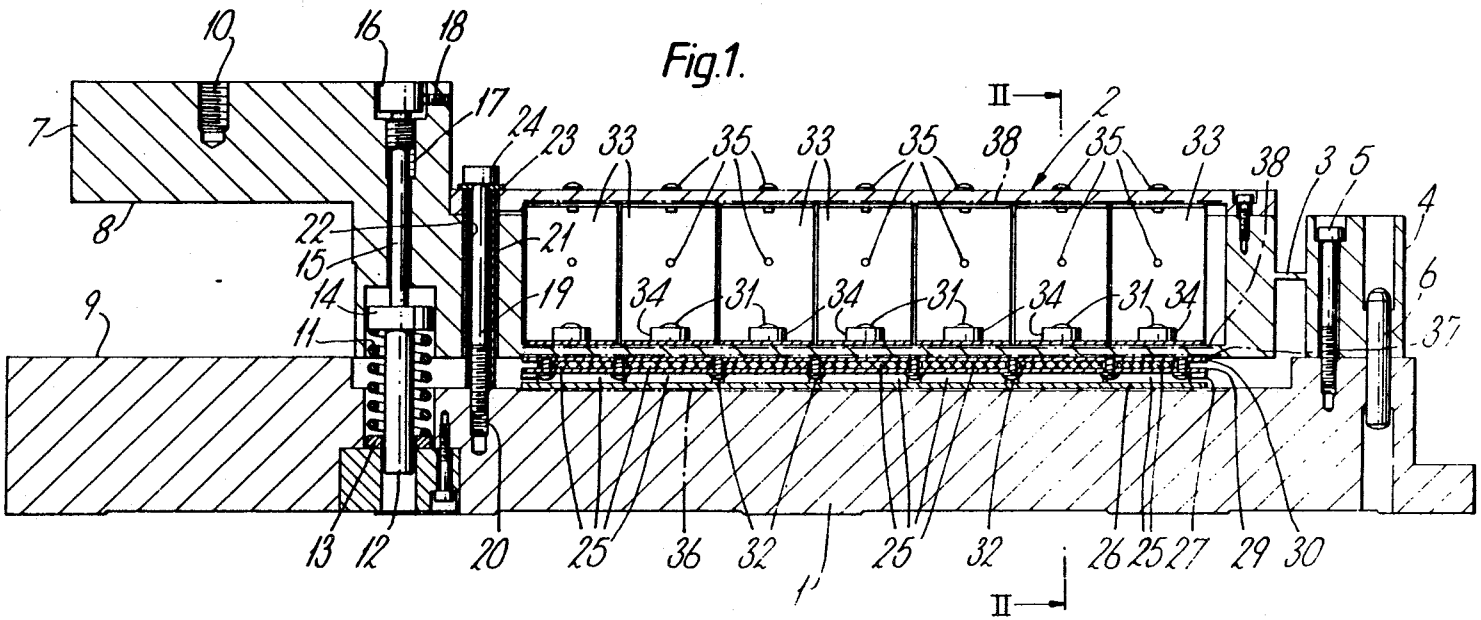

This invention relates to a punching or stamping machine comprising a fixed first member carrying a first tool and a movable second member which carries a second tool for cooperation with the first tool in the operation of the machine, the second member being supported by the first member and being connected thereto by means which permit operative movement of the second member relative to the first member. In the case of a punching machine the tools consist of a punch and a die; in a stamping machine they may be male and female dies, for example.

The invention relates particularly, though not exclusively, to punching and stamping machines which operate on thin material with very high precision, such as punching machines used in the manufacture of, for example, lead frames for integrated circuits and shear foils for dry-shavers. In these punching machines, which operate with a very short stroke, for example 5 mm, the fixed first member of the machine carries a plurality of dies and the movable second member carries a corresponding plurality of punches for cooperation with the dies. To ensure the necessary precision in the operation of the machine, it is vital that extreme accuracy be maintained in the alignment of the punches and the dies. This requires that there shall be no, or substantially no, relative movement between the movable and fixed members of the machine, or parts thereof, in a direction transverse to the direction of movement of the punches. To use a rotational pivot as the connecting means between the two members would result in wear due to friction in the pivot which could in due course permit movement, albeit a very slight movement, of the movable member transversely of the direction of movement of the punches. Relative movement in this direction between the movable and fixed members can also be caused by differential thermal expansion or contraction of the two members resulting from fluctuations in ambient temperature, for example.

It is an object of the invention to provide a punching or stamping machine of the kind described in the opening paragraph, in which relative movement between the movable and fixed members of the machine in a direction transverse to the direction of operative movement of the movable member does not occur, at least to any significant degree.

According to the invention there is provided a punching or stamping machine comprising a fixed first member carrying a first tool and a movable second member which carries a second tool for cooperation with the first tool in the operatin of the machine, the second member being supported by the first member and being connected thereto by means which permit operative movement of the second member relative to the first member, characterised in that the first and second members are of elongate form and extend substantially parallel with one another and carry the respective tools at one end, the connecting means between the two members comprise a resiliently flexible web which lies in a plane transverse to the direction of operative movement of the second member and which is joined to each member at the end thereof remote from the respective tool, the two members are made of the same material and the movable second member is of hollow construction, and the two members are interconnected by flexible elements which are made of a material of good thermal conductivity for transferring heat between the two members.

The web which forms the connecting means between the first and second members has a flexibility sufficient to permit the necessary operative movement of the second member relative to the first member, but due to the disposition of the web in a plane transverse to the direction of operative movement of the second member, and to the rigidity of the web in this plane, no significant displacement of the second member relative to the first member can occur in a direction transverse to the direction of operative movement of the second member. Unlike a pivotal connection the web is not subject to wear; nor does it require lubrication.

The interconnection of the first and second members by flexible elements made of a material of good thermal conductivity, for example, copper, permits a transfer of heat between the two members which maintains a thermal balance between them and inhibits differential thermal expansion or contraction of the members. Relative movement which might occur between the members in a direction transverse to the direction of operative movement of the second member as a result of such differential expansion or contraction is thus also inhibited.

The maintenance of a thermal balance between the first and second members is facilitated by the hollow construction of the second member, which reduces its mass and therefore its heat capacity.

To obtain a rapid transfer of heat between the first and second members a preferred embodiment of the invention is characterised in that the second member is lined with a material of good thermal conductivity, the lining having heat-conducting connection with said flexible elements by way of elements made of a material of good thermal conductivity which extend through the wall of the second member.

A compact and constructionally simple embodiment of the invention is characterised in that said flexible elements are arranged between the first and second members and consist of flexible strips of a material of good thermal conductivity, each of which extends transversely of and is connected to the two members and which are distributed longitudinally of said members, and in that said lining is formed by a plurality of separate strips of a material of good thermal conductivity, each of which extends around and is secured to the inner side of the wall of the second member and each of which is aligned with one of said flexible strips and has heat-conducting connection therewith.

The rate of heat transfer between the first and second members is further increased in an embodiment of the invention which is characterised in that first and second plates of a material of good thermal conductivity are fixed against two sides of the first and second members respectively which face one another and between which said flexible elements are arranged, and the latter elements are attached to these plates in contact therewith.

Yet a further increase in the rate of heat transfer between the first and second members is achieved by providing layers of a material of good thermal conductivity on the surface of the first member at the side thereof to which said first plate is fixed and on the inner and outer surfaces of the wall of the second member.

Figure 2:
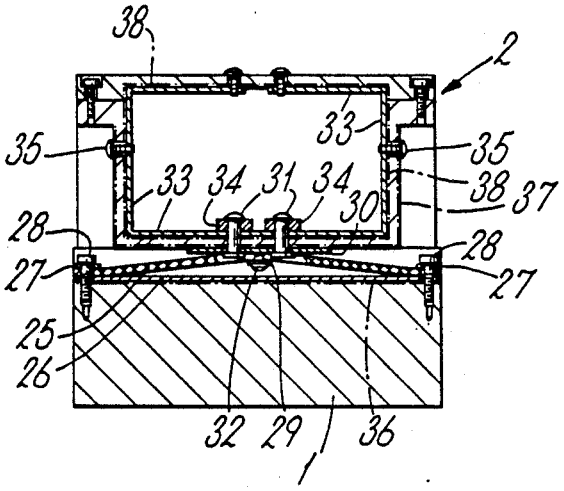
Figure 3:
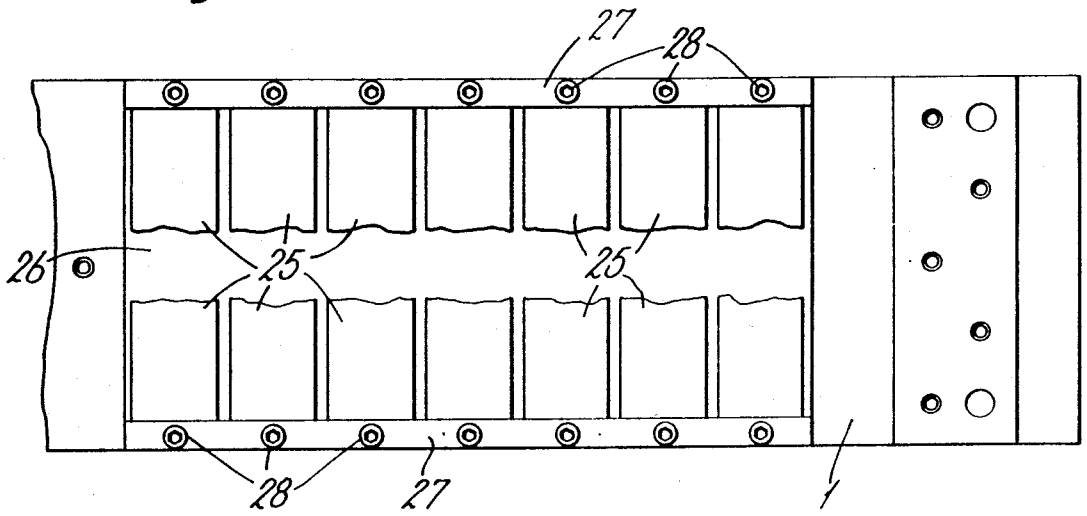

An embodiment of the invention will now be described by way of example with reference to the accompanying drawing, in which:

FIG. 1 is a sectional side elevation of a punching machine constructed in accordance with the invention, FIG. 2 is a sectional view taken on the line II—II in FIG. 1, and FIG. 3 is a plan view of part of the fixed member of the machine, showing portions of the flexible heat-conducting elements which interconnect the fixed and movable members.

The punching machine shown in the drawings comprises a horizontally disposed, solid elongate base 1 which forms the fixed member of the machine and an arm 2 of hollow, elongate, box construction which extends substantially parallel to the base and constitutes the movable member. The base 1 and the arm 2, which is of rectangular cross-section, are made of the same material, namely, an alloy steel having a low thermal conductivity. At one end the arm 2 is connected by a narrow, elongate, resiliently flexible web 3 to a block 4 of the same material as the arm 2, which block is fixed to the upper side of the base 1 by screws, one of which, designated 5, can be seen in FIG. 1. The block 4 and the base 1 have accurately machined cooperating faces, and the block and with it the arm 2 are accurately located on the base 1 by locating pins, one of which, designated 6, can be seen in FIG. 1. The web 3 extends horizontally across the end wall of the arm 2 from one side of the arm to the opposite side. It is integral with the end wall of the arm and with the block 4 and is sufficiently flexible to permit the necessary movement of the arm 2 towards and away from the base 1 in the operation of the machine.

At its end remote from the web 3 the arm 2 comprises a mounting 7 having on its lower side an accurately machined face 8 on which can be mounted a cassette (not shown) containing a plurality of punches. A similar face 9 is provided on the upper side of the base 1 opposite the face 8 to form a mounting for a second cassette (not shown) containing a plurality of dies. Means (not shown) are provided on the arm 2 and the base 1 for accurately positioning the cassettes, and therefore the punches and dies, on the faces 8 and 9.

In the operation of the machine the arm 2 is moved downwards towards the base 1 in the punching stroke by a mechanism which is not shown in the drawing and which may be of any convenient known form. The mounting 7 on the arm 2 is formed with a threaded bore 10 in its upper side to receive a connection (not shown) to the operating mechanism. The arm 2 is moved upwards in the return stroke by a compression coil spring 11 housed partly in the base 1 and partly in the arm 2. The spring surrounds a push-rod 12 and bears at its lower end against a fixed annular abutment 13 in the base 1 and at its upper end against a collar 14 on the push-rod 12. The push-rod extends through a bore 15 in the arm 2 and bears at its upper end against an adjustable abutment in the form of a screwthreaded plug 16 which is screwed into a threaded bore 17 in the arm 2 and is locked in position by a grub-screw 18. Adjustment of the abutment 16 alters the compression of the spring 11.

The return stroke of the arm 2 is limited by an adjustable stroke-limiter consisting of a cheese-headed, screwthreaded steel pin 19 which is screwed into a threaded bore 20 in the upper side of the base 1. The pin is surrounded by a sleeve 21 which extends with clearance through a bore 22 in the arm 2 and which is held at its ends between the base 1 and a washer 23 beneath the head 24 of the pin 19. The upper limit of the stroke of the arm 2 is determined by abutment of the upper side of the arm against the washer 23, as shown in FIG. 1.

By constructing the connection between the arm 2 and the base 1 as a resiliently flexible web which is integral with the arm and the base, or with a part which is rigidly fixed to the base, as in the present embodiment, an extremely accurate, play-free guidance of the arm, and therefore the punches carried by the arm, is obtained. The flexibility of the web permits a substantially rectilinear operative movement of the arm and the punches in the vertical direction. Since the web lies substantially in a horizontal plane and is rigid in this plane, there can be no significant displacement of the arm relative to the base in a horizontal direction, so that the necessary accuracy in the alignment of the punches and the dies is maintained. Being integral with the end wall of the arm 2 and with the block 4 the web 3 is rigid in a direction perpendicular to the longitudinal axis of the arm, that is to say, it cannot bend about this axis or any axis parallel thereto, and therefore the web will not allow any rotational movement of the arm about its longitudinal axis, which further ensures maintenance of the accuracy of alignment of the punches and the dies.

The alignment of the punches and the dies could also be affected by relative movement between them in a horizontal direction due to differential thermal expansion or contraction of the arm 2 and the base 1 caused by fluctuations in ambient temperature, for example. To inhibit such differential expansion or contraction, means are provided for permitting a ready exchange of heat between the base and the arm so as to maintain a thermal balance between them. These means mainly comprise flexible elements 25 which interconnect the base 1 and the arm 2 and which are made of a material of good thermal conductivity, preferably copper. In the embodiment shown the connecting elements 25 consist of braided copper strips arranged between the underside of the arm 2 and the upper side of the base 1 and each extending transversely of the arm and the base. The strips are closely spaced along the arm and the base and are each secured at their ends to the base and at their centres to the arm. At their ends the strips 25 are in contact with a plate 26 which extends over the upper side of the base 1 in contact therewith and which is made of a material of good thermal conductivity, preferably copper. The strips 25 are clamped to the plate 26 at their ends by two comparatively rigid metal strips 27 (FIGS. 2 and 3) which are fastened to the base 1 by screws 28. The central portions of the strips 25 are clamped between a rigid metal strip 29 at the underside and an elongate plate 30 of a material of good thermal conductivity, preferably copper, which is fixed against the bottom wall of the arm 2. The plate 30 extends longitudinally of the arm 2 and is fastened to the bottom wall thereof by copper rivets 31 or by other suitable fastening elements which extend through the bottom wall of the arm and are made of a material of good thermal conductivity. The strip 29 is fastened to the plate 30 by screws 32. The flexible strips 25 are shown broken away in their central areas in FIGS. 2 and 3.

The arm 2 is lined internally with a material of good thermal conductivity, preferably copper. In the embodiment shown the lining is formed by a plurality of rigid copper strips 33 of approximately the same width as the flexible copper strips 25, each strip 33 being aligned with one of the strips 25 and being fastened to the bottom wall of the arm 2 by the two copper rivets 31, or other fastening elements, which secure the central portion of the respective strip 25 to this wall by means of the plate 30 and strip 29. Copper washers 34 are interposed between the heads of the rivets 31 and the copper strips 33 to increase the area of contact between these strips and the rivets. The strips 33 are fastened to the top and side walls of the arm 2 by screws 35. By constructing the lining of the arm 2 as a number of separate elements slightly spaced from one another, allowance is made for the difference in thermal expansion and contraction between the copper of the lining and the steel of the arm.

Without impeding the operative movement of the arm 2 the thermally conductive flexible strips 25 provide a path for the transfer of heat between the base 1 and the arm 2 so that a thermal balance is maintained between them which inhibits differential thermal expansion or contraction of the base and the arm. The rate of transfer is increased by the provision of the copper plates 26 and 30 and the copper strips 33. Thus, a path for the optimum transfer of heat between the base 1 and the arm 2 is established by the plate 26, strips 25, plate 30, rivets 31, washers 34 and strips 33, all of which are made of copper and therefore have a high thermal conductivity. The maintenance of a thermal balance between the base 1 and the arm 2 is facilitated by the hollow, box construction of the arm 2, which results in a rigid lightweight structure of low mass and therefore low heat capacity. This construction of the arm 2 has a further advantage in reducing the inertia of the arm in its operative movement.

The copper plate 26 ensures that heat is transferred between the base 1 and the flexible strips 25 across the whole width of the base and not just locally at the ends of the strip 25. To improve the heat transfer between the base 1 and the plate 26 a layer of a material of good thermal conductivity, for example, copper or aluminium, is provided on the upper surface of the base 1, as indicated by the dot-dash line 36 in FIGS. 1 and 2. Similar layers 37 and 38 are provided on the outer and inner surfaces of the walls of the arm 2 to assist the transfer of heat between the place 30 and the walls of the arm and between the strips 33 and the walls of the arm, respectively. The layers 36, 37 and 38 may be applied by a sputtering process.

The construction described above for a punching machine can equally well be used for a stamping machine according to the invention.

What is claimed is:

1. A punching or stamping machine comprising a fixed first member carrying a first tool and a movable second member which carries a second tool for cooperation with the first tool in the operation of the machine, the second member being supported by the first member and being connected thereto by means which permit operative vertical movement of the second member relative to the first member, wherein the first and second members are of elongate form and extend substantially parallel with one another and carry the respective tools at one end, the connecting means between the two members comprise a resiliently flexible web which lies in a horizontal plane and which is joined to each member at the end thereof remote from the respective tool, the two members are made of the same material and the movable second member is of hollow construction, and the two members are further interconnected by flexible elements which are made of a material of good thermal conductivity for transferring heat between the two members, said connecting means comprising said web providing for substantially free movement of said first and second members in the direction of operative vertical movement and being substantially fixed against movement in a substantially horizontal direction perpendicular to said direction of operative vertical movement.

2. A punching or stamping machine as claimed in claim 1, wherein the second member is lined with a material of good thermal conductivity, the lining having heat-conducting connection with said flexible elements via elements made of a material of good thermal conductivity which extend through the wall of the second member.

3. A punching or stamping machine as claimed in claim 2, wherein said flexible elements are arranged between the first and second members and consist of flexible strips of a material of good thermal conductivity, each of which extends transversely of and is connected to the two members and which are distributed longitudinally of said members, and wherein said lining is formed by a plurality of separate strips of a material of good thermal conductivity, each of which extends around and is secured to the inner side of the wall of the second member and each of which is aligned with one of said flexible strips and has heat-conducting connection therewith.

4. A punching or stamping machine as claimed in claim 1, 2 or 3, wherein first and second plates of a material of good thermal conductivity are fixed against two sides of the first and second members respectively which face one another and between which said flexible elements are arranged, which flexible elements are attached to these plates in contact therewith.

5. A punching or stamping machine as claimed in claim 4 wherein layers of a material of good thermal conductivity are formed on the surface of the first member at the side thereof to which said first plate is fixed and on the inner and outer surfaces of the second member.

6. A punching and stamping machine as claimed in claim 1 wherein said connecting means comprising said web is substantially fixed against rotational movement about the longitudinal axis of said second member.

* * * * *